United States Patent [19]

Neesbye-Hansen

[11] 4,455,055

[45] Jun. 19, 1984

[54] CABINET FOR BLINK LIGHT

[76] Inventor: Per Neesbye-Hansen, Damgaardsvej 11, DK-2930 Klampenborg, Denmark

[21] Appl. No.: 350,612

[22] Filed: Feb. 22, 1982

[30] Foreign Application Priority Data

Feb. 20, 1981 [DK] Denmark ..... 758/81

[51] Int. Cl.[3] ..... A47B 77/08; G09F 13/00; G09F 7/02

[52] U.S. Cl. ..... 312/223; 312/100; 312/111; 40/549; 40/607; 40/612

[58] Field of Search ..... 312/223, 111, 100; 40/607, 609, 612, 549; 46/226, 228

[56] References Cited

U.S. PATENT DOCUMENTS

| | | | |
|---|---|---|---|
| 1,620,087 | 3/1927 | Estes | 40/612 |
| 1,912,549 | 6/1933 | Sprung | 40/607 |
| 2,507,875 | 5/1950 | Williams | 40/607 |
| 2,759,281 | 8/1956 | Akers, Jr. | 40/607 |
| 3,235,989 | 2/1966 | Brooks | 40/549 |
| 3,635,305 | 1/1972 | Kunishi et al. | 312/223 |
| 3,762,600 | 10/1973 | Kreutzweiser | 312/111 |
| 3,847,460 | 11/1974 | Weidt | 312/111 |
| 3,874,103 | 4/1975 | Muta | 40/607 |
| 4,253,415 | 3/1981 | Ferch | 40/612 |
| 4,317,302 | 3/1982 | Von De Linde | 40/549 |

FOREIGN PATENT DOCUMENTS

| | | | |
|---|---|---|---|
| 7801793 | 8/1979 | Netherlands | 40/607 |

*Primary Examiner*—Victor N. Sakran

*Attorney, Agent, or Firm*—Burgess, Ryan & Wayne

[57] ABSTRACT

A cabinet for warning blink lights is built up of two identical half parts comprising a shroud (1), a bottom (2) with a holding part (3) for a stand or column, said half parts also being provided with a projection (12) and corresponding recess (13), and also a high internal rib (6) and a cooperating low rib (7) which have a projection (9) and a recess (10) at their respective end surfaces, thus allowing the half parts to be interlocked, in that the projection (12) is engaged with the recess (13) and the projections (9) go down in the recesses (10). Any mutual displacement between the half parts is thus prevented.

In addition, a bolt assembly is possible through a tubular stub (11), said stub having end surfaces which slope upwards towards the top of the half part, whereby the half parts are effectively secured together when the bolt is tightened.

4 Claims, 4 Drawing Figures

CABINET FOR BLINK LIGHT

Figure 1:
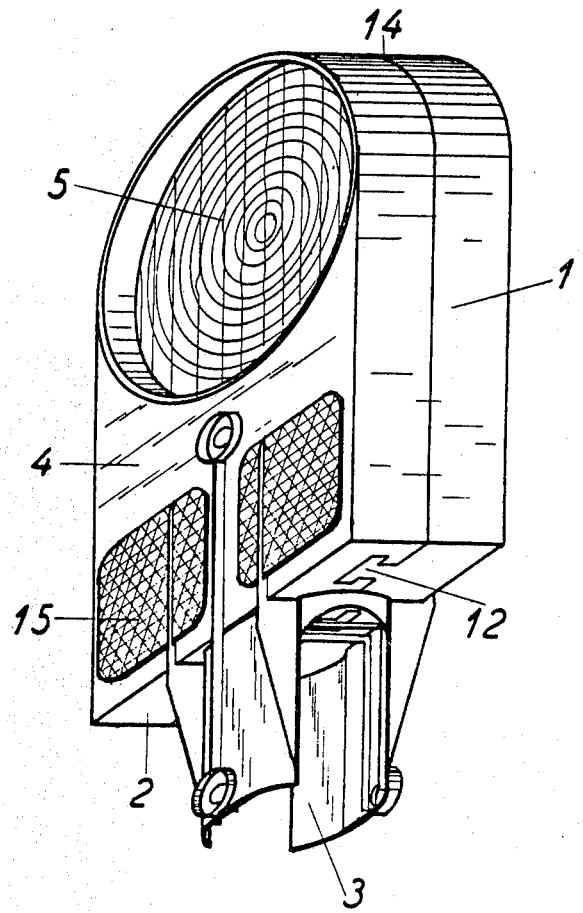

This invention concerns a cabinet and relates in particular to a cabinet for blink lights used for purposes of warning and containing a cabinet-mounted light source which can be connected to a light-sensitive element for activating and de-activating the blink function, said cabinet being capable of being mounted on a stand or column.

Blink lights of this kind are used, for example, for mounting on stands to provide warning and guidance for road-users. They are known in many different embodiments and forms and are usually manufactured of many individual parts, these parts being assembled to form a finished housing containing a light source. The known blink-light cabinets have various disadvantages, one of these being that they are rather expensive to produce because of the many separate components, and another being that assembly of the blink function is very time-consuming. This also means that a relatively large number of spare parts must be available, for example to fire authorities, who maintain and repair their own blink lights. Finally, the known cabinets are provided with a more or less good bush or securing bracket which makes it difficult to prevent them from being removed from their stands. Furthermore, they are easily damaged when such attempts to remove them are made.

The object of this invention is to overcome the disadvantages and drawbacks connected with the manufacture and maintenance of such blink lights, and this is achieved when the cabinet is built up of two identical half parts, each comprising a shroud, a bottom with a holding part for the stand, and a side wall with a light field and internal ribs running parallel with the symmetrical axis of the half part, and where the one rib is higher than the other and such that their end surfaces lie close to each other when the cabinet is put together. First and foremost, what is thus achieved is a simplification of the production of the cabinet, which now comprises only two identical cabinet parts which, when assembled, form the finished cabinet with a light field and room for the necessary light source, while at the same time having the holder for mounting on the stand built in. By providing the half parts with ribs, an effective stiffening of the holding parts is achieved, whereby a completely rigid construction is achieved when the securing bolt is tightened. Moreover, the holding parts can be stiffened further both internally and externally by providing these and the cabinet with rib reinforcement. The cabinet thus becomes inexpensive to produce and maintain, while at the same time a robust cabinet is achieved.

By providing the ribs with an interacting projection and recess, as presented in claim 2, the half parts are prevented from mutual displacement.

Furthermore, the holding parts can be provided with a tubular stub with inclined end surfaces, as presented in claim 3, whereby the top of the cabinet is subject to extra compression upon tightening of the bolt.

Finally, and as presented in claim 4, the bottom and/or the top can be provided with interacting projections and recesses, whereby the cabinet is locked together.

Figure 2:
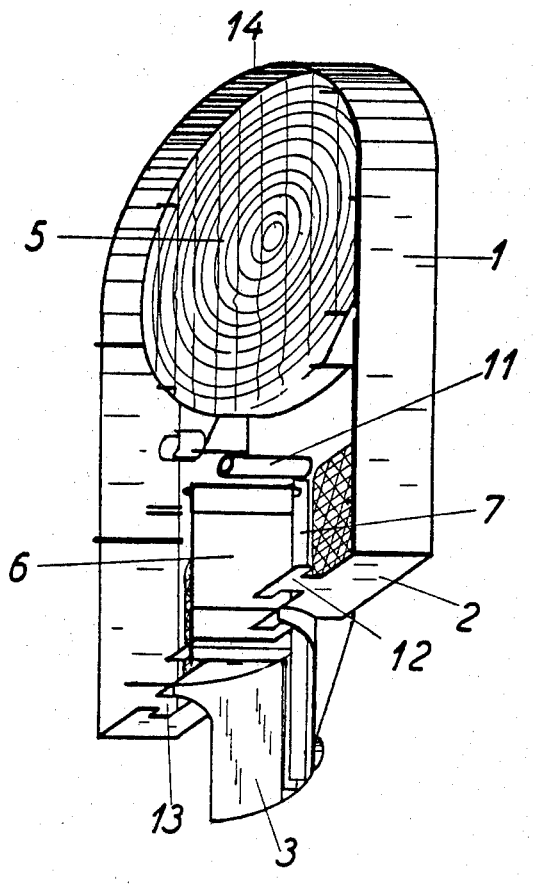
Figure 3:
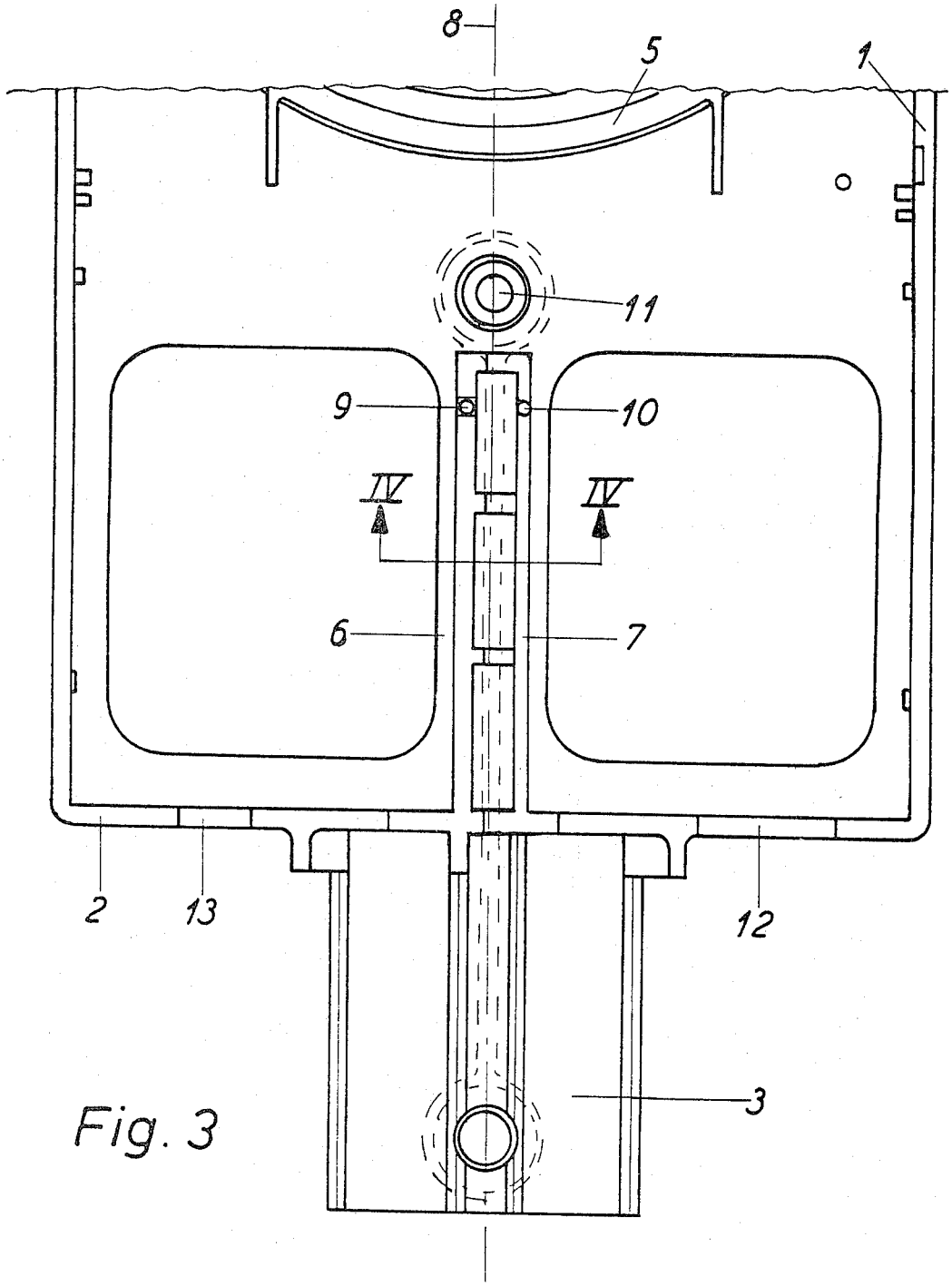
Figure 4:
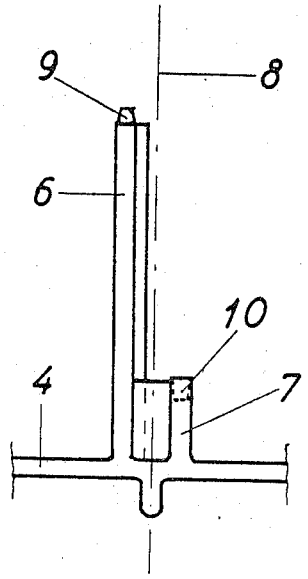

The invention will now be described in more detail and with reference to the accompanying drawings, where FIG. 1 is a perspective drawing of an assembled cabinet, FIG. 2 is a view of the inside of a half part, FIG. 3 is an inside view of the lower part of the half part, and FIG. 4 shows the ribs seen in section IV—IV in FIG. 3.

As will be seen in FIG. 1, which shows one embodiment in accordance with the invention, the cabinet comprises a closed housing with a holder to receive and surround a stand or column (not shown). The cabinet is formed of two identical half parts, one of which is shown in FIG. 2.

The half part consists of a side wall 4 with a circular light field 5 above and with two rectangular reflector fields 15 below. Moreover, a shroud 1 runs from the bottom 2 all the way around the side.

As will be seen more clearly in FIGS. 3 and 4, the inside of the half part is provided with two parallel ribs 6 and 7 disposed equidistantly from the symmetry axis 8. The ribs extend from the bottom 2 and upwards to the proximity of the bolt hole with a tubular stub 11 for control of the bolt.

The one rib 6 is higher than the other rib 7, but the height is proportioned in such a way that their end surfaces lie a short distance from the opposing ribs. When the cabinet is assembled by means of the bolt, the end surfaces of the ribs are pressed towards each other, thus forming a closed and rigid construction. A holding part 3, which can be of a form to suit the stand around which is to hold, extends from the bottom 2. The holding part 3 can be provided both with internal as well as external ribs which extend for a suitable distance in over the sides 4 of the half parts. Such ribs can extend in over the internal ribs 6, 7, thus providing considerable rigidity between the holder and the cabinet. The internal ribs can be wedge-shaped with a sharp edge capable of cutting into a wooden post.

In the embodiment shown, the internal ribs 6, 7 are further provided with a projection 9 on the high rib 6 and with a corresponding recess 10 in the low rib 7. When the two half parts of the cabinet are being tightened together, the projections 9 go down in the recesses 10, thus preventing any displacement of the half parts in relation to each other.

As shown in FIGS. 2 and 3, the bolt assembly consists of a through-going hole surrounded by a tubular stub 11. The end surface of the stub is slanting, in that it slopes outwards towards the top 14 of the half part. When the bolt (not shown) is inserted and tightened, the two tops 14 and ribs 6, 7 are pressed positively towards each other, thus providing a much-desired tightness and security against undesired separation.

At the bottom 2 and/or the top 14, and in extension of same and on the one side of the symmetry axis 8, there is further provided a T-shaped projection 12, while on the other side of said axis there is a T-shaped recess 13. The corresponding projections and recesses enable the bottoms to be locked together, in that the half parts can be assembled and separated only by displacement of the parts. Thus, when the bolt is tightened, the holding parts are prevented in a very simple manner from parting from each other, and in particular there is created security against the half parts being separated in the transverse direction.

The half parts can be produced in one piece of plastic, preferably polycarbonate. The light field is transparent, but can be coloured as required, just as the rest of the part.

I claim:

1. A cabinet for warning blink lights and adapted to contain a light source and photosensitive means for controlling the blinking of said light source, said cabinet being mountable on a stand or column and comprising:

a shroud having a top, a bottom and front and rear major surfaces, each of said major surfaces having a light transmissive portion, said bottom surface being adapted for mounting on a stand or column, said shroud comprising two interlocked identical half parts, each half part comprising one of said major surfaces and a portion of each of the other surfaces of said shroud, each half part having a central axis bisecting the major surface thereof and extending between said top and bottom surfaces, each half part having a pair of unequal height parallel internal ribs disposed adjacent said central axis and extending from the major surface of said half part, said ribs being disposed on opposite sides of said central axis and extending in a direction parallel thereto, the end surface of the high rib of each half part mating with the end surface of the low rib of the other half part, at least one of the bottom and top surfaces of each half part having (i) a projection of interlocking shape extending away from the major surface thereof and disposed on one side of said central axis, and (ii) a recess of corresponding interlocking shape disposed on the opposite side of said central axis and extending toward said major surface, so that the projection of each of said half parts interlocks with the recess of the other half part.

2. A cabinet for warning blink lights and adapted to contain a light source and photosensitive means for controlling the blinking of said light source, said cabinet being mountable on a stand or column and comprising:

a shroud having a top, a bottom and front and rear major surfaces, each of said major surfaces having a light transmissive portion, said bottom surface being adapted for mounting on a stand or column, said shroud comprising two interlocked identical half parts, each half part comprising one of said major surfaces and a portion of each of the other surfaces of said shroud, each half part having a central axis bisecting the major surface thereof and extending between said top and bottom surfaces, each half part having a pair of unequal height parallel internal ribs disposed adjacent said central axis and extending from the major surface of said half part, said ribs being disposed on opposite sides of said central axis and extending in a direction parallel thereto, the end surface of the high rib of each half part being disposed contiguous with the end surface of the low rib of the other half part.

3. The cabinet according to claim 2, wherein at least one of the bottom and top surfaces of each half part has (i) a projection of interlocking shape extending away from the major surface thereof and disposed on one side of said central axis, and (ii) a recess of corresponding interlocking shape disposed on the opposite side of said central axis and extending toward said major surface, so that the projection of each of said half parts interlocks with the recess of the other half part.

4. The cabinet according to claim 2, wherein the end surface of one rib of each of said half parts is provided with a protuberance and the end surface of the other rib thereof is provided with a mating hole.

* * * * *